US009243471B2

(12) United States Patent
Bisset et al.

(10) Patent No.: US 9,243,471 B2
(45) Date of Patent: Jan. 26, 2016

(54) REMOVABLE PACKER PLUG WITH INSTALLATION BYPASS FEATURE

(71) Applicant: Baker Hughes Incorporated, Houston, TX (US)

(72) Inventors: Stephen Bisset, Kingwood, TX (US); Steve Rosenblatt, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 311 days.

(21) Appl. No.: 13/860,331

(22) Filed: Apr. 10, 2013

(65) Prior Publication Data

US 2014/0305629 A1 Oct. 16, 2014

(51) Int. Cl.

| | |
|---|---|
| ***E21B 34/14*** | (2006.01) |
| ***E21B 33/12*** | (2006.01) |
| ***E21B 33/134*** | (2006.01) |

(52) U.S. Cl.

CPC ..... *E21B 33/12* (2013.01); *E21B 33/134* (2013.01)

(58) Field of Classification Search

CPC ..... E21B 34/063; E21B 34/12; E21B 34/14
See application file for complete search history.

(56) References Cited

U.S. PATENT DOCUMENTS 4,076,083 A * 2/1978 Sizer ..... 175/65
5,765,641 A * 6/1998 Shy et al. ..... 166/292

OTHER PUBLICATIONS

Baker Hughes, Baker Oil Tools, Model "F" Latching Type Packer Plug, Oct. 2003, 1 page.
Baker Hughes Incorporated, Retrievable Bridge Plugs, F Latching-Type Packer Plug, 1 page.

* cited by examiner

*Primary Examiner* — Catherine Loikith
(74) *Attorney, Agent, or Firm* — Steve Rosenblatt

(57) ABSTRACT

A plug for a seal bore in a packer mandrel has a shiftable annular member that can selectively open bypass ports to facilitate latching and then be shifted as part of a release from the plug by a running tool to close the bypass passage that go around a frangible barrier that will later be broken by impact force. The annular member has minimal structure internally to allow attachment of the running tool. The annular member drillout proceeds quickly with minimal cuttings and the frangible member is broken by impact. On an assembly with multiple packers getting plugs a trip is saved as a plug is delivered into a lower packer with a string supporting the packer above. The plug is set in the lower packer allowing release of the running string for subsequent placement and setting of the next packer in the same trip.

19 Claims, 4 Drawing Sheets

REMOVABLE PACKER PLUG WITH INSTALLATION BYPASS FEATURE

FIELD OF THE INVENTION

The field of the invention is completions and more particularly when portions of a zone are perforated, flow tested and isolated in sequence and thereafter the isolated zones are to be opened to produce through packers previously used for zone isolation.

BACKGROUND OF THE INVENTION

In some completions after the well is drilled to the zone of interest, a packer is set on a string that conveys a perforating gun and a lowermost portion of the zone of interest is perforated. The gun is removed and a plug is delivered into the first packer to isolate the lower zone after an initial flow test is conducted. The lowermost region is now isolated and the process repeats in an uphole direction as many times as is necessary. The plug that can be used is a Model F Latching Packer Plug sold by Baker Hughes Incorporated. This plug has a selectively open bypass to facilitate mechanical latching when advancing the plug against formation pressure. The bypass prevents a potential liquid lock that would otherwise impede advancement of the plug until it latched to the packer bore with the seal assembly properly positioned in a polished bore normally extending below the packer mandrel. This plug has an unloader sub that can be selected for a bypass flow configuration or the bypass can be closed with a j-slot which also allows removal of the running string so that the packer is in effect a bridge plug. At a later time this plug will need to be removed to produce from the zone that is below it. If there are no obstructions above plug, its removal simply requires acquiring the j-pin mandrel at the top with a retrieval tool and pulling the plug out of the packer mandrel. If there are other packers above the packer in question with a Model F Plug in it then the plug has to be removed by other means such as drilling it out. Because the Model F is built to accomplish many objectives such as operating as a bypass device and holding differential pressure, trying to mill out such a plug can generate lots of cuttings that then have to be captured with wellbore cleanup tools such as the VACS Tool offered by Baker Hughes. The cuttings that do not get captured can migrate to undesired locations to make subsequent operations in the wellbore more problematic. Beyond that the Model F Plug is placed in a respective packer in a separate trip after the fired guns are removed and the initial flow test is conducted. As previously stated then another packer is run in and set with a string having a perforating gun and the process repeats.

What is need is a plug design that contemplates drillout so that cuttings are minimized while a drift diameter that is made available is maximized while the drillout time is minimized. What is also needed is a way to save trips when dividing a zone into segments that each is flow tested and plugged and later produced necessitating plug removal when there are obstructions above. What is provided is a bottom hole assembly that can deliver and latch a suitable plug to a lower packer while delivering the packer above. In that instance the plug is set in the lower packer and the running tool releases from the set plug to allow the string to be manipulated to position and then set the packer above. This saves a trip in the hole compared to comparable systems used before. Those skilled in the art will more readily appreciate these and other aspects of the invention from a review of the detailed description and the associated figures while appreciating that the full scope of the invention is to be determined from the appended claims.

SUMMARY OF THE INVENTION

A plug for a seal bore in a packer mandrel has a shiftable annular member that can selectively open bypass ports to facilitate latching and then be shifted as part of a release from the plug by a running tool to close the bypass passage that go around a frangible barrier that will later be broken by impact force. The annular member has minimal structure internally to allow attachment of the running tool. The annular member drillout proceeds quickly with minimal cuttings and the frangible member is broken by impact. On an assembly with multiple packers getting plugs a trip is saved as a plug is delivered into a lower packer with a string supporting the packer above. The plug is set in the lower packer allowing release of the running string for subsequent placement and setting of the next packer in the same trip.

DETAILED DESCRIPTION OF THE PREFERRED EMBODIMENT

Figure 1:
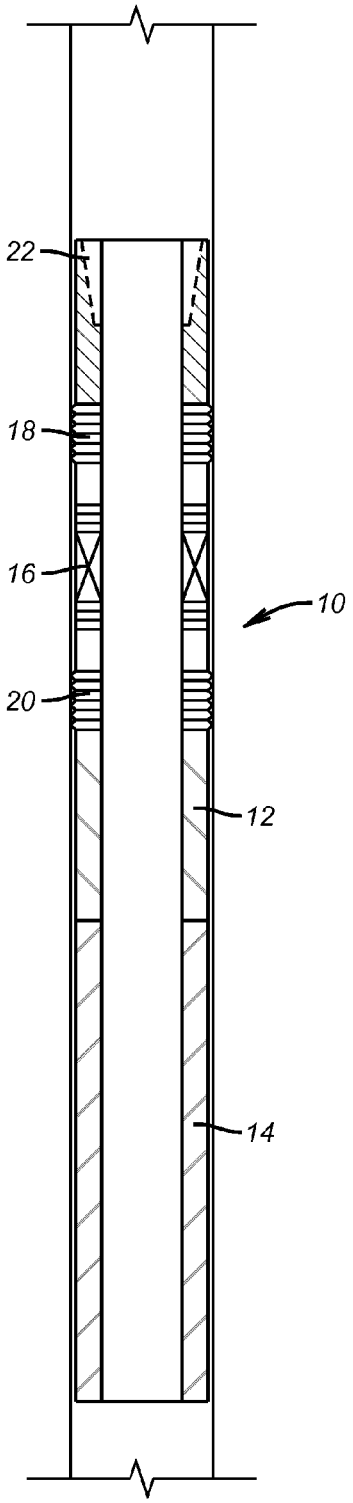
(PRIOR ART) FIG. 1
FIG. 1 is a section view of a known packer having a passage therethrough and a seal bore at a lower end of the mandrel.
Figure 2:
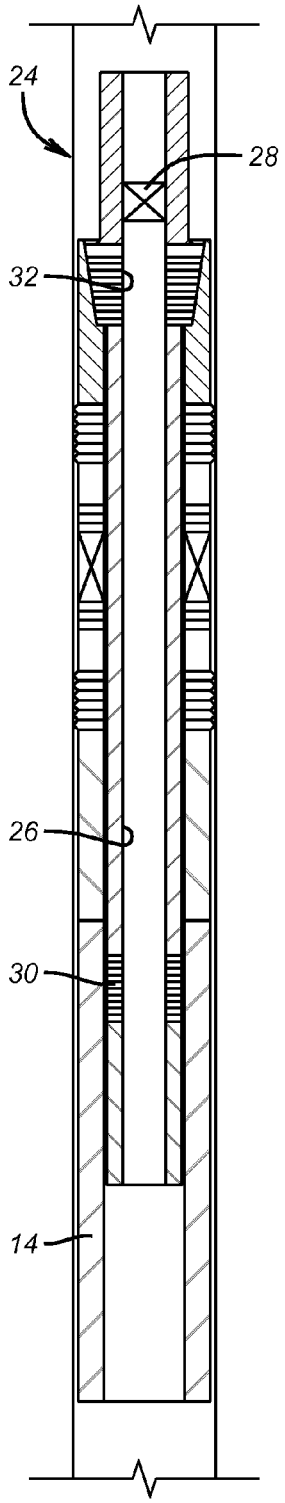
(PRIOR ART) FIG. 2
FIG. 2 is a schematic illustration of possible liquid lock when installing a prior design plug into a packer open to formation pressure.

By way of background, FIG. 1 represents a known packer 10 having a mandrel 12 and a polished bore extension 14. The packer 10 has a sealing element 16 flanked by upper slips 18 and lower slips 20. An anchor latch 22 is used to retain a plug 24 as shown in FIG. 2. The plug 24 has a through passage 26 that is blocked by a barrier 28. Seal assembly 30 lands in polished bore extension 14 and latch mechanism 32 lands and latches to anchor latch 22. When flow is desired at a later time through passage 26 the barrier 28 is removed by drilling or other means. The issue with this design is when trying to latch the plug against formation pressure. Because the passage 26 is blocked by barrier 28 it will frequently require a great deal of force to essentially buck the formation pressure so that the plug 24 can sufficiently advance to allow it to latch. As previously discussed, the Baker Hughes Model F Packer Plug has an unloader feature that allows temporary bypassing of the passage barrier in the plug and then closing the bypass when a running tool is released from the plug. However, this tool is fairly complex and has a j-slot actuation mechanism and was not initially designed to be milled out in situation where there are uphole restrictions that prevent its normal removal with a fishing tool that grips a fishing neck at the tool upper end. Because of this trying to millout this plug will generate significant cuttings that need capture and take a great deal of time.

Figure 3C:
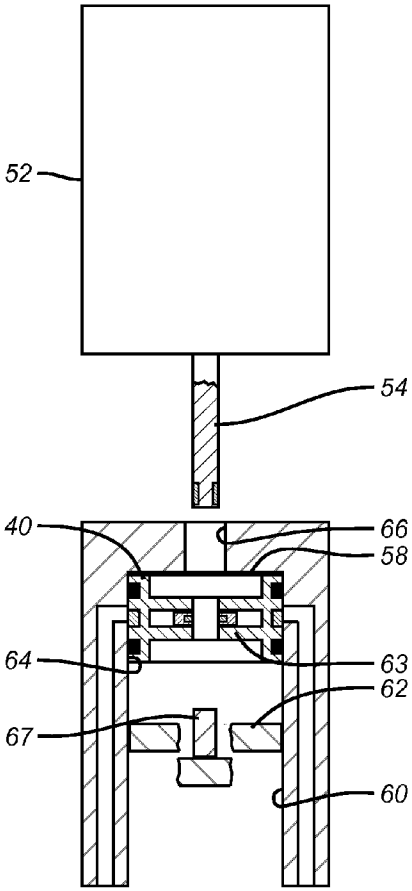
FIG. 3C is in alternative to FIG. 3B showing using a shear ring and a sinker bar.
Figure 3B:
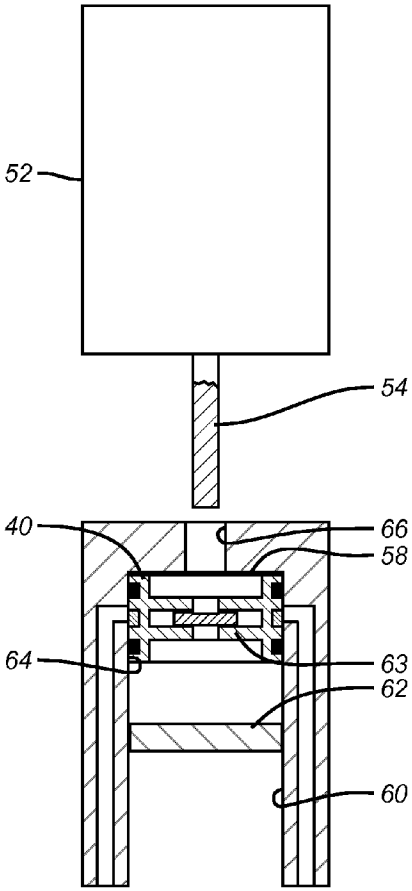
FIG. 3B is the view of FIG. 3A where the running tool has shifted the bypass plug to close the bypass ports while releasing from the shifted plug.
Figure 3A:
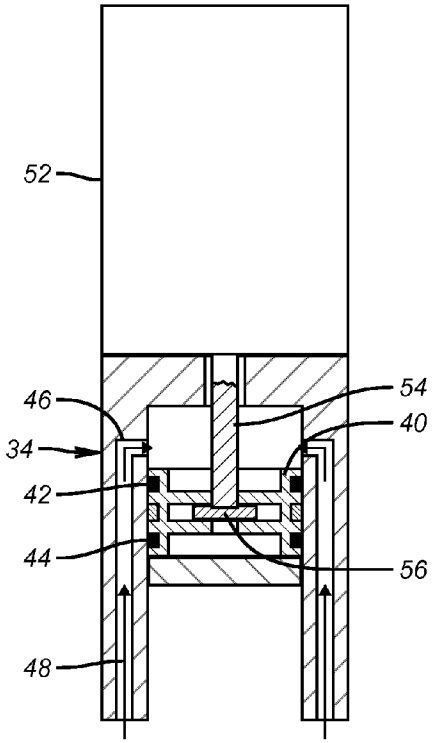
FIG. 3A is a schematic illustration of the running tool attached to the shiftable plug for run in with the bypass passages open.
Figure 4A:
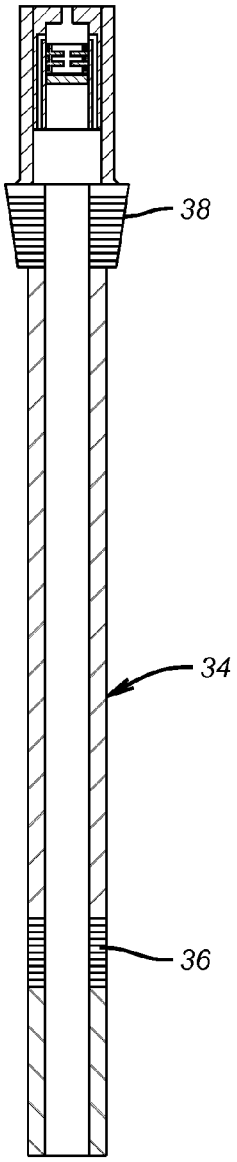
FIG. 4A is a view of the plug in the run in configuration.
Figure 4B:
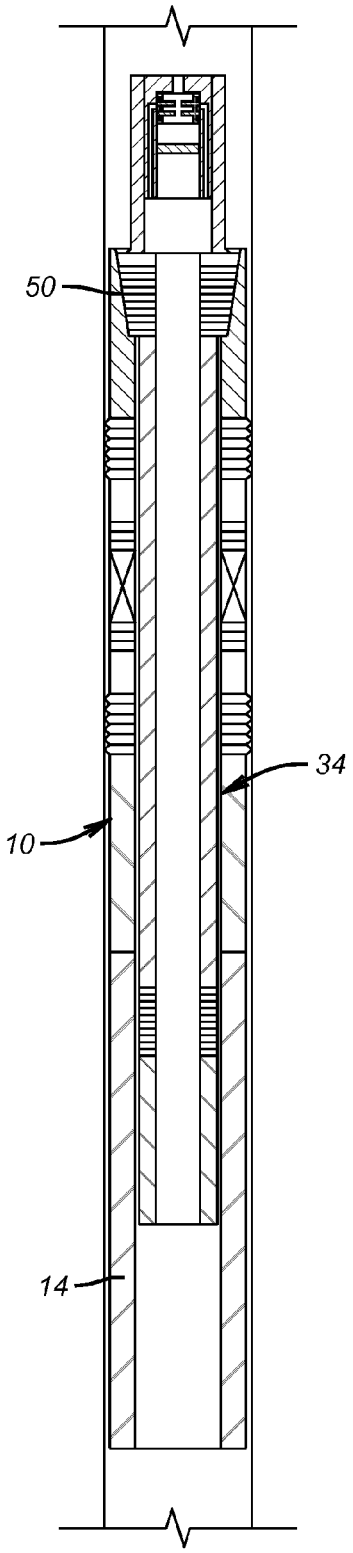
FIG. 4B is the view of FIG. 4A with the plug latched and the bypass passages closed.

FIGS. 3A and 3B show a preferred way to provide a temporary bypass for plug latching while designing the components for rapid millout that provides a drift dimension at least as large as the mill doing the millout with minimal cuttings generation. The run in position is shown on FIG. 3A and FIG. 4A shows the entire plug 34 that has external seals 36 and an anchor latch 38 all of which operate as before when describing plug 24. The difference is in movable plug 40 which has an annular or ring shape with spaced external seals 42 and 44 that are run in offset from bypass passage 46 to allow flow represented by arrow 48 to bypass the seal assembly 36 as the plug 34 is advanced into position to allow anchor latch 38 to anchor at 50 on the packer assembly 10. The running tool 52 is illustrated very schematically and has a shearable member 54 attached to plug 40 at cross member 56. Raising the running tool will raise the plug 40 until it hits shoulder 58 at which point the bypass passage 46 will be closed because seals 42 and 44 straddle its opening as shown in FIG. 3B. Further pulling up will separate 54 and 54 so that the running tool 52 can be removed. The plug passage 60 is still plugged by a barrier 62 preferably one that can shatter on mechanical contact from an object such as a ceramic disc for example. Internally to the plug 40 is a web structure of struts, schematically illustrated as 63 extending from an inner wall 64 that are configured to allow retention to the running tool 52 until the plug 34 is latched to the packer 10. Opening 66 is not to scale and is preferably just smaller than the passage 60 to allow for the creation of the shoulder 58. As a result when it is time to produce through a packer 10 plugged with plug 34, a mill that is not shown is advanced through opening 66 and simply mills the very open web structure 63. On impact of the mill with the barrier 62 the barrier shatters and the passage 60 is open for production flow or other purposes.

Those skilled in the art will appreciate that the barrier 62 can be removed in other ways such as reactively or thermally for example. The open web structure of the equalizing plug 40 when used in tandem with the barrier 62 allows fast millout with minimal cuttings to capture and a procedure that allows the millout to happen in a short time. The internal components of the structure 63 can be composites, ceramics or other non-metallics or soft metals to facilitate rapid millout.

Figures 5, 6, 7, 8, 9, 10, 11, 12, 13:
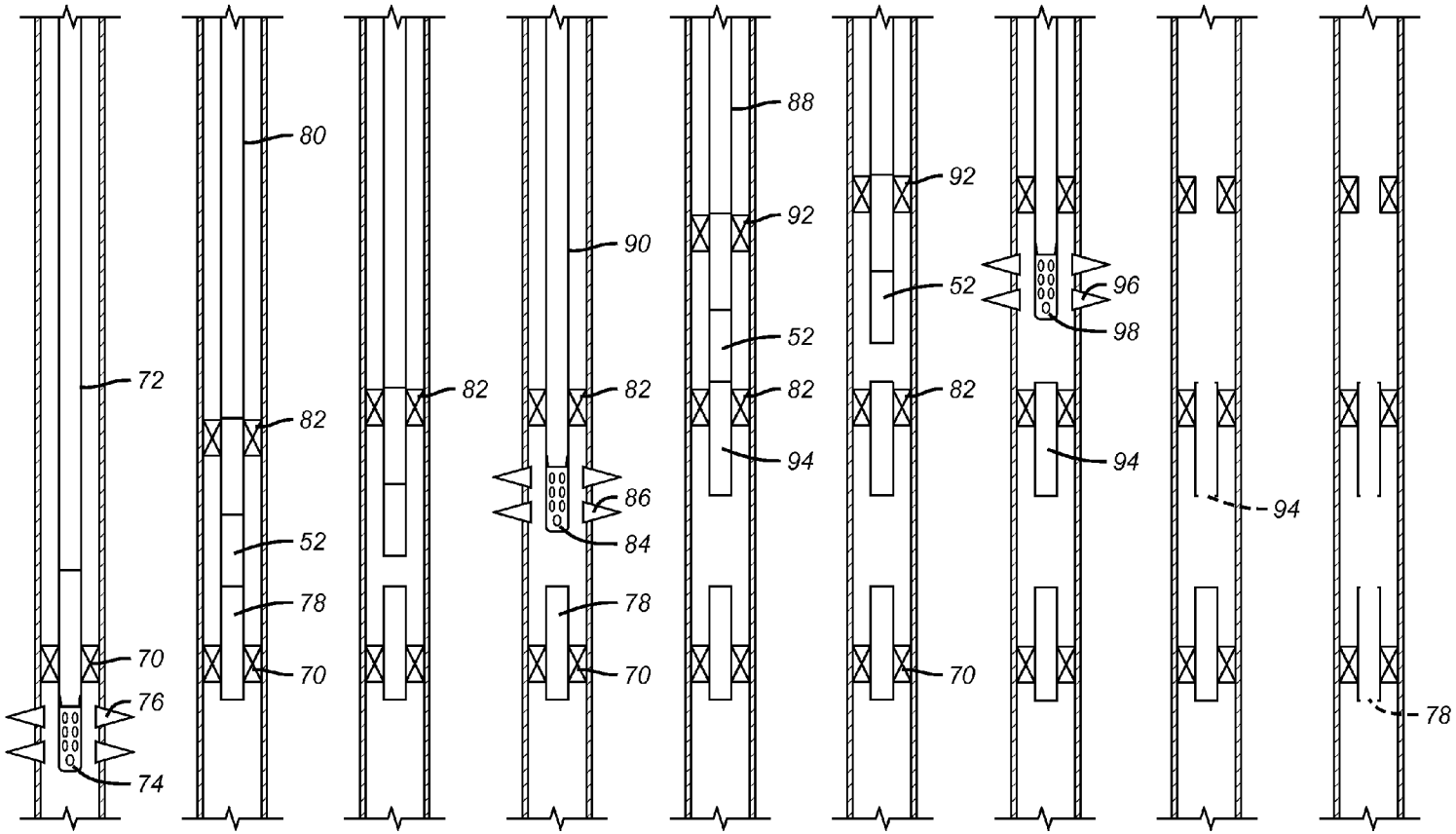
FIG. 5 shows a first packer set and the zone below it being perforated.
FIG. 6 is the view of FIG. 5 with a plug delivered into the lower packer as the next packer is also run into the well.
FIG. 7 is the view of FIG. 6 with the running tool released from the latched lower plug and the second packer repositioned for setting.
FIG. 8 shows a perforating gun run through the second packer and set off.
FIG. 9 shows a plug for the second packer delivered in the same trip as a third packer.
FIG. 10 shows the second packer plugged and the running string repositioned for setting the third packer.
FIG. 11 shows a perforating gun run through the third packer and shot.
FIG. 12 shows the plug from the second packer is removed allowing tandem production from the top two intervals together.
FIG. 13 shows the plug removed from the bottom packer allowing tandem production from the three illustrated intervals.

Referring now to FIGS. 5-13 another aspect of the invention will be illustrated that relates to the feature of saving a trip in the hole by delivering a plug for one packer in the same trip as the packer that is due to be set above. In FIG. 1 a first packer 70 of a type previously described is run and set in position. A string 72 that supports a perforating gun 74 is then run through the packer 70. When the gun 74 is properly located, the gun 74 is fired into the formation lower zone 76. FIG. 6 shows that the gun 74 is removed and what is next run in is a first plug 78 on a running tool 52 as previously described. The assembly is delivered on a running string 80 that also supports the second packer 82. The assembly is advanced until the first plug 78 lands in first packer 70 with the plug 40 in the FIG. 3A position so that the first plug 78 can be latched as previously described. After latching, a pickup force is applied to the string 80 to get the plug 40 to move up as previously described and to release the running tool 52 from the first plug 78 also in the manner previously described. The string 80 can then be raised to locate second packer 82 at the proper spacing from first packer 70. It is worth noting at this point that after setting the first packer 70 a flow test can be run on the lower zone 76 before the first plug 78 is installed in the first packer 70. Also, a portion of the running tool 52 or all of it can remain with the second packer 82 after release from the first plug 78 as shown in FIG. 7. While illustrated schematically, those skilled in the art will appreciate that the running tool 52 has a passage therethrough to accommodate subsequent flow therethrough in either direction.

FIG. 8 shows gun 84 below the second packer 82 perforating an intermediate zone 86 while supported on string 90. First packer 70 is plugged with plug 78 and second packer 82 is set. As previously described for FIGS. 5-7 the process is the same for FIGS. 8-10 except the action is higher up in the wellbore. As shown in FIG. 9 a string 88 delivers a third packer 92 and a second plug 94. The assembly is advanced to land plug 94 in second packer 82 and latch to it. Again the running tool 52 shifts a plug 40 and there is a shear release from the second plug 94. The string 88 is picked up to position the third packer 92 the desired distance from second packer 82 and the string 88 is removed. At this point in FIG. 10 the first and second packers 70 and 82 are plugged and perforation of the upper zone 96 with gun 98 can take place. As stated before, a flow test can take place after each gun firing before the packer in question is plugged. In the case of FIG. 11, production from zone 96 can begin with plug 94 in place. As shown in FIG. 12 the plug 94 has been milled out as previously described so that tandem production from zones 96 and 86 can take place. Subsequently, when plug 78 is drilled out production from all three zones including 76 can take place in tandem.

Those skilled in the art will appreciate that the design of the packer plugs lends itself to rapid millout with minimal cuttings and in minimal time. A breakable barrier 62 in conjunction with a ring shaped plug 40 with an internal web of struts 63 or other structure that is fairly minimal allows this to happen. The structure is sufficient for attaching the running tool 52 and for a shear release that separates items 54 and 56. In a completion with multiple zones or a sectioned single zone that takes multiple perforations separated with packers such as illustrated in FIGS. 5-13 the ability to deliver the next packer when plugging a previous packer saves rig time. The prior Model F Baker Hughes plug is delivered in a separate trip and is principally designed to be removed when whole with a fishing tool. When there is an obstruction above and a plug such as the Model F has to be milled there are delays due to the need to remove significant portions of a metallic body not designed to be milled. The present system mounts the running tool for a plug to the lower end of a subsequent packer allowing the two to be delivered in tandem and then separated for subsequent setting of the packer after latching the plug that it formerly supported. The plug structure of having an open through passage closed with a removable member with bypass passage in the plug wall allows the use of a ring shaped valve associated with the running tool that is secured to the ring shaped plug with a minimal internal structure such that a pickup force slides the plug to close the bypass and shears for release. This leaves very little structure to mill out. A retaining shoulder at the plug top acts as a travel stop for the bypass plug as the running tool is shear released. The mill is sized to fit the opening at the plug top to provide the larger drift dimension for subsequent fluid flow or tools. The plug is designed to break on impact with the mill after the mill gets through the struts in the equalizer valve that previously held the running tool before the valve was shifted and the running tool shear released from the valve. The connection between the running tool actuator and the valve 40 can be a peripheral shear ring on the inside wall of the tubular valve such as an 1-shaped ring one side of which comes out with the running tool actuator 54, 56 as opposed to leaving in any part of the actuator to later mill out. Doing the release this way only leaves a part of the shear ring inside the valve 40 so that there is virtually nothing to mill out and leaving the possibility open to breaking the barrier 62 with a sinker bar 67 and without milling.

The above description is illustrative of the preferred embodiment and many modifications may be made by those skilled in the art without departing from the invention whose scope is to be determined from the literal and equivalent scope of the claims below:

We claim:

1. A packer plug assembly for a packer, comprising:
a tubular body having a wall and an axial through passage extending down from an upper end thereof;
a seal assembly and a grip assembly on an outer surface of said tubular body for engaging the packer;
a selectively removable plug in said passage; and
a valved bypass passage around said plug, said bypass passage located in said wall of said tubular body.

2. The assembly of claim 1, wherein:
said valved bypass passage comprises a tubular valve member disposed in said axial through passage.

3. The assembly of claim 2, wherein:
said tubular valve member selectively covering said bypass passage.

4. The assembly of claim 3, wherein:
said tubular valve member translates axially in said axial passage.

5. The assembly of claim 4, wherein:
said tubular valve member is disposed closer to said tubular body upper end than said plug.

6. The assembly of claim 5, wherein:
said tubular valve member is open to flow therethrough in said axial passage.

7. A packer plug assembly, comprising:
a tubular body having an axial through passage extending down from an upper end thereof;
a seal assembly and a grip assembly on an outer surface of said tubular body;
a selectively removable plug in said passage; and
a valved bypass passage around said plug;
said valved bypass passage comprises a tubular valve member disposed in said axial through passage;
said tubular valve member selectively covering said bypass passage;
said tubular valve member translates axially in said axial passage;
said tubular valve member is disposed closer to said tubular body upper end than said plug;
said tubular valve member is open to flow therethrough in said axial passage;
a running tool with an actuator extending into said axial passage and internally engaging said tubular valve member;
said tubular valve member having an initial position that is offset from said bypass passage;
said running tool axially shifting said tubular valve member before releasing therefrom.

8. The assembly of claim 7, wherein:
said tubular body having a radial stop surface adjacent an upper end thereof that extends into said axial passage;
said tubular valve member engaging said stop surface when moved by said running tool actuator to release said actuator.

9. The assembly of claim 8, wherein:
said tubular valve member comprising spaced external seals that straddle said bypass passage when said actuator releases from said tubular valved member.

10. The assembly of claim 9, wherein:
said actuator shear releases from said tubular valve member.

11. The assembly of claim 10, wherein:
said actuator is held to said tubular valve member with a shear element in said tubular valve member;
separation of said actuator from said tubular valve member by breaking said shear element allows said actuator to be fully removed from said tubular valve member leaving said plug substantially exposed.

12. The assembly of claim 11, wherein:
said plug is made of a breakable material that breaks in response to a mechanical force.

13. The assembly of claim 12, further comprising:
a sinker bar that selectively engages said plug to break it and open the plug assembly to flow without milling.

14. The assembly of claim 7, wherein:
said tubular valve member having an open strut structure therein for connection of said actuator;
a portion of said actuator shearing off and remaining with said strut structure after moving said tubular valve member to close said bypass passage;
said strut structure and plug subsequently removed for flow access through said axial passage.

15. A packer plug assembly, comprising:
a tubular body having an axial through passage extending down from an upper end thereof;
a seal assembly and a grip assembly on an outer surface of said tubular body;
a selectively removable plug in said passage; and
a valved bypass passage around said plug;
a running tool with an actuator;
said valved bypass passage comprises a tubular valve selectively axially movable by said actuator to close said bypass passage;
said actuator separating from said tubular valve member after shifting said tubular valve member leaving the interior of said tubular valve member substantially unobstructed.

16. The assembly of claim 15, wherein:
said plug is substantially exposed in said axial passage on removal of said actuator.

17. The assembly of claim 16, wherein:
said plug is removable from said axial passage after removal of said actuator without milling.

18. The assembly of claim 16, wherein:
said actuator initially attached to said tubular valve member with a shear ring inside said tubular valve member;

said actuator and a portion of said shear ring coming out of said tubular valve member after said tubular valve member hits a travel stop in said axial passage.

19. The assembly of claim 16, wherein:

said plug is ceramic.

* * * * *